US007258114B2

(12) United States Patent
Rice

(10) Patent No.: US 7,258,114 B2
(45) Date of Patent: Aug. 21, 2007

(54) PAINTBALL MARKER FEATURING A STRUCTURALLY INDEPENDENT RAM

(76) Inventor: Jack V. Rice, 9006 Wimbley Ct., Elk Grove, CA (US) 95624

( * ) Notice: Subject to any disclaimer, the term of this patent is extended or adjusted under 35 U.S.C. 154(b) by 379 days.

(21) Appl. No.: 11/051,323

(22) Filed: Feb. 3, 2005

(65) Prior Publication Data

US 2006/0107937 A1 May 25, 2006

Related U.S. Application Data

(60) Provisional application No. 60/541,556, filed on Feb. 3, 2004.

(51) Int. Cl.
*F41B 11/00* (2006.01)

(52) U.S. Cl. ..... 124/72

(58) Field of Classification Search ..... 124/73–77
See application file for complete search history.

(56) References Cited

U.S. PATENT DOCUMENTS

| | | | | |
|---|---|---|---|---|
| 5,462,042 | A | 10/1995 | Greenwell | |
| 5,497,758 | A | 3/1996 | Dobbins | |
| 5,503,137 | A | 4/1996 | Fusco | |
| 5,673,679 | A | 10/1997 | Walters | |
| 5,769,066 | A | 6/1998 | Schneider | |
| 6,003,504 | A * | 12/1999 | Rice et al. | 124/73 |
| 6,343,599 | B1 | 2/2002 | Perrone | |
| 6,371,099 | B1 | 4/2002 | Lee | |
| 6,520,171 | B2 | 2/2003 | Reible | |
| 6,532,949 | B1 * | 3/2003 | McKendrick | 124/77 |
| 6,766,795 | B1 * | 7/2004 | Sullivan | 124/56 |
| 6,802,306 | B1 | 10/2004 | Rice | |
| 2002/0096164 | A1 | 7/2002 | Perrone | |
| 2003/0075161 | A1 | 4/2003 | Fujimoto | |

OTHER PUBLICATIONS

Insight Component Engineering; The Epic; "http://icepaintball.com/" internet web site; Apr. 3, 2001.

* cited by examiner

*Primary Examiner*—Troy Chambers
(74) *Attorney, Agent, or Firm*—Heisler & Associates

(57) ABSTRACT

A paintball marker or other compressed gas firearm is provided including a ram driven by an electropneumatic valve when a trigger is actuated to cause a main valve between a high pressure air supply and a firing chamber to be opened. This ram assembly is independent from the main valve structurally and coupled to the air supply and electropneumatic valve sufficiently flexibly to allow the ram assembly to be operable when the ram assembly is displaced away from the main valve. A bolt is provided for directing pressurized air from the main valve to the firing chamber when the main valve is opened, and with the bolt configured to provide a high pressure air pathway which has a high degree of effectiveness in driving the ball out of the firing chamber without distorting a trajectory of the ball. The bolt can be stationary when air is flowing past the bolt.

20 Claims, 9 Drawing Sheets

PAINTBALL MARKER FEATURING A STRUCTURALLY INDEPENDENT RAM

CROSS-REFERENCE TO RELATED APPLICATIONS

This application claims benefit under Title 35, United States Code §119(e) of U.S. Provisional Application No. 60/541,556 filed on Feb. 3, 2004. This application also incorporates by reference the entire contents of U.S. Pat. No. 6,802,306 and U.S. patent application Ser. No. 10/877,742, having a filing date of Jul. 8, 2004.

FIELD OF THE INVENTION

The following invention relates to paintball markers and other firearms which deliver a projectile through force applied by compressed air or other gases. More particularly, this invention relates to paintball markers or related firearms which include a ram assembly between a trigger and a high pressure valve which can be inspected and tested while separated from other portions of the marker, and markers which control airflow for projectile launch with a high degree of effectiveness.

BACKGROUND OF THE INVENTION

Paintball markers are known in the art for firing projectiles in the form of frangible balls filled with paint (called "paintballs") to a target. Such paintball markers typically utilize compressed air to launch the paintball from a firing chamber within the marker and out of a barrel pointed at the target. Compressed air powered firearms are also known for projectile delivery firearms other than paintball.

Such compressed air powered firearms known in the prior art include numerous generally similar components arranged in similar ways to fire the paintball or other projectile from the firearm. In particular, such typical compressed air firearms include a body supporting the firing chamber and barrel thereon, and with a handle grippable by a hand of the user. A trigger is located near the handle and in a position where fingers of the user can readily actuate the trigger. A source of compressed gas (usually air) is typically provided in the form of a canister attachable to the body of the firearm. This high pressure air source is in fluid communication with the firing chamber in a removable fashion.

Typically, a main valve is provided between the high pressure air source and the firing chamber which controls flow of high pressure air to the firing chamber. The trigger is coupled to this main valve in some way so that actuation of the trigger causes the valve to open momentarily and allow a charge of compressed air to pass from the source of high pressure air to the firing chamber. Within the firing chamber, a ball is loaded through some form of load lock mechanism. The air is entered into the firing chamber behind the ball so that the air expands behind the ball pushing the ball out of the barrel.

While the trigger can be coupled to the main valve in many different ways, it is known with some paintball markers, and other compressed gas firearms, to control the opening and closing of this main valve through the utilization of a ram which moves to open the main valve. The trigger is coupled to the ram to cause the ram to move. One common arrangement for trigger and ram coupling involves providing an electropneumatic valve between an electric source selectively closed by actuation of the trigger and an electrically powered solenoid within the electropneumatic valve capable of opening and closing air passages leading to the ram for control of ram position. Typically, such electropneumatic valves are powered by compressed air which is often at a lower pressure than the high pressure air from the source of high pressure air.

Often a regulator or other pressure reducer is provided so that the high pressure air can also supply this low pressure air for powering the electropneumatic valve. Such a regulator can also allow fine tuning of pressure provided from the source of high pressure air to the firing chamber for launching the paintball. The solenoid within the electropneumatic valve can further be controlled by a logic circuit such as can be provided in an integrated circuit located upon a printed circuit board with other circuitry to properly control the electropneumatic valve and hence the ram and main valve. A power supply, such as a battery, is also typically provided to power the circuitry.

With regard to the ball delivery load lock, typically a feed tube is provided near the firing chamber which feeds paintballs or other projectiles, typically by gravity, into or near the firing chamber. With many paintball markers and other compressed air firearms, a bolt is provided co-linear with the barrel and the firing chamber. Such a bolt can slide forward along this line to advance the ball or other projectile into the firing chamber and to close communication between the firing chamber and the feed tube, so that compressed air delivered behind the ball has no place to escape except out of the barrel behind the paintball.

Particular prior art embodiments of paintball markers are typically generally similar to each other as described above, but are further modified in each individual paintball marker embodiment to improve performance, simplify construction, or to achieve other purposes. Such known prior art paintball markers have not been entirely satisfactory in some aspects. One problem encountered with many paintball markers is that after some period of use the paintball marker will cease operating properly. Because many of the elements of the paintball marker are hidden within an enclosed body it is often difficult to determine which portion of the paintball marker requires service to again achieve satisfactory performance. For instance, if the trigger is toggled with a ball in the firing chamber and yet the ball has not fired and no charge of compressed air leaves the firearm, a multitude of different potential problems could produce such a result. It is thus difficult for a user or maintenance personnel to diagnose the problem. Accordingly, a need exists for paintball markers and other compressed air firearms which can have various portions thereof fully operational in isolation from other portions of the firearm for troubleshooting purposes.

Another problem encountered with many prior art paintball markers and other compressed air firearms is that the paintballs or other projectiles do not travel from the barrel to the target in as linear a fashion as would be optimal. Rather, most prior art paintball markers impart some undesirable amount of spin to the projectile or other deformation so that after a relatively short distance the paintballs are inclined to miss the target at which the barrel is pointed. While one partial solution to this problem is to increase the pressure of air used in firing the paintball, there are limits to such an approach. Excessive pressure can cause the paintball to rupture prematurely within the paintball marker. Also, excessive velocity of the paintball can make the paintball an excessively great hazard to personnel or property which the paintball strikes. Accordingly, a need exists for paintball markers and other compressed air firearms which can utilize high pressure air as effectively as possible to deliver the paintball more precisely at a target.

SUMMARY OF THE INVENTION

With this invention, a paintball marker or related compressed gas powered firearm is provided which can have separate subassemblies of the marker operated while the marker is disassembled and which maintains airflow of high effectiveness from a source of high pressure gas through the marker for firing the paintball or other projectile.

The marker includes a body within which various different subassemblies of the marker are supported. These subassemblies include a barrel from which paintballs are fired located adjacent a firing chamber where the paintball resides before high pressure air launches the paintball out of the barrel. A paintball input is located near the firing chamber which delivers paintballs into or near the firing chamber when reloading of the firing chamber is required.

A high pressure air source is coupled to the body and a main valve is interposed between the high pressure air source and the firing chamber so that high pressure air can be selectively delivered to the firing chamber when the main valve is open. A trigger is provided which is coupled, at least indirectly, to the main valve so that a user can actuate the trigger and cause the main valve to open and the paintball to be fired from the firing chamber out of the barrel.

A ram assembly is provided between the main valve and the trigger. The ram assembly is provided with a housing having a bore therein. A piston is adapted to reside within the bore and move within the bore when the trigger is actuated. A shaft is coupled to the bore and extends to a shaft end referred to as a hammer. The hammer is coupled to the main valve, such as by physical contact, to cause the main valve to open and close when the hammer is adjacent the main valve.

The entire ram assembly including the housing, bore, piston, shaft and hammer are removable away from the main valve while the ram assembly is still operatively coupled to the trigger. In such a partially disassembled configuration, actuation of the trigger still causes the piston and hence the associated hammer to move. However, the hammer does not strike the main valve. Thus, operation of the ram assembly can be viewed and inspected without requiring that a paintball be fired and with the ram assembly partially removed from the body so that it can be visually inspected to verify proper operation of the ram assembly.

The high pressure air pathway from the high pressure air source, through the main valve, and on to the firing chamber is carefully configured to avoid excess turbulence and so that pressure drops are minimized through the various different portions of the high pressure air pathway. In particular, the high pressure air pathway passes through the main valve and then to the firing chamber, preferably passing along a surface of a bolt. The bolt is provided in line with the firing chamber and the barrel to advance the paintball from the feed tube to the firing chamber and to block off the feed tube before the high pressure air is passed from the main valve to the firing chamber for launching of the projectile. Surfaces of the bolt which form portions of the high pressure air pathway are configured to minimize pressure losses and turbulence of the air flowing past the bolt. In particular, curves in the bolt, as well as within the main valve, are configured to be gradual and having a relatively large radius of curvature. With such a configuration for the high pressure air pathway, high effectiveness air flow is delivered against the ball with low pressure drops and in a sufficiently uniform fashion that forces applied to the ball impart a minimum amount of spin or other distortion on the ball, but rather encourage smooth launching of the paintball from the firing chamber and out of the barrel for a precision flight to the target.

In one embodiment of the invention, the bolt is configured so that portions of the bolt which are adjacent the high pressure air pathway between the high pressure air source and the firing chamber are stationary at the time that the high pressure air is flowing past the bolt. Preferably, to accomplish this the bolt is compound in form with two separate portions including a forward portion and a rearward portion.

The forward portion includes portions of the high pressure air path thereon and is configured to abut a stop and to be stationary when high pressure air flow occurs adjacent the forward portions. The rearward portion is adapted to move independently from the forward portion at least part of the time, with a spring or other resilient member joining the forward portion and the rearward portion together. With the forward portion of the compound bolt remaining stationary during firing, maximum smoothness of high pressure air flow adjacent the bolt and to the firing chamber is achieved for the most effective airflow and associated paintball trajectory upon launch from the firing chamber.

OBJECTS OF THE INVENTION

Accordingly, a primary object of the present invention is to provide a paintball marker or other high pressure air powered firearm which is easy to maintain and troubleshoot.

Another object of the present invention is to provide a paintball marker or other high pressure gas powered firearm which can deliver a paintball or other projectile with a high degree of precision.

Another object of the present invention is to provide a paintball marker which operates reliably and accurately.

Another object of the present invention is to provide a paintball marker which can have separate subassemblies operate when the paintball marker is partially disassembled to assist in troubleshooting.

Another object of the present invention is to provide a paintball marker which can rapidly and reliably fire paintballs.

Another object of the present invention is to provide a paintball marker which includes a ram assembly and associated housing which is independent from other portions of a body of the paintball marker for separate inspection and replacement.

Another object of the present invention is to provide a paintball marker which is easy to use and easy to aim for successful delivery of a paintball to a target.

Another object of the present invention is to provide a paintball marker which efficiently utilizes a charge of high pressure gas for launch of a paintball.

Other further objects of the present invention will become apparent from a careful reading of the included drawing figures, the claims and detailed description of the invention.

DESCRIPTION OF THE PREFERRED EMBODIMENT

Figures 1, 2:
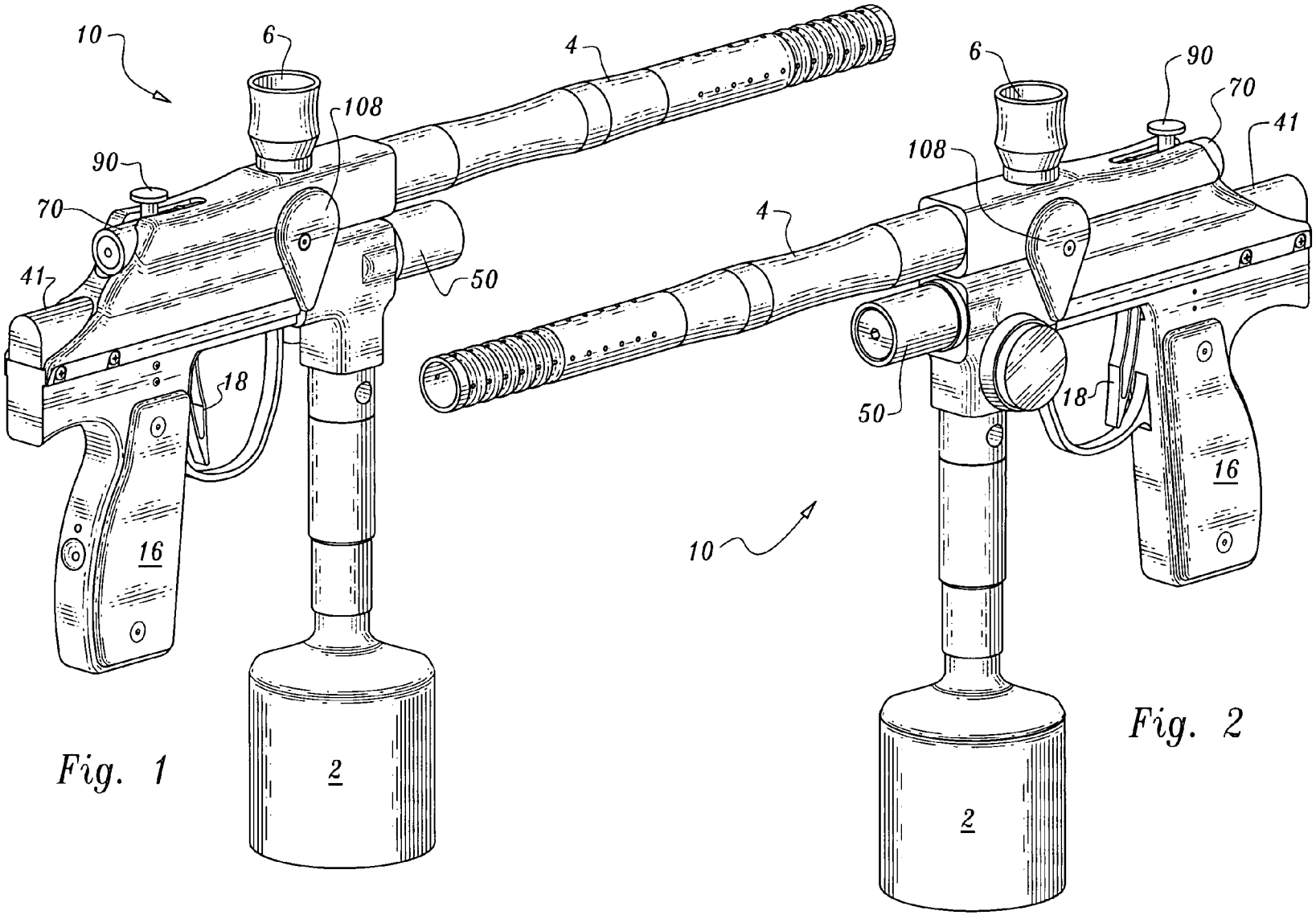
FIGS. 1 and 2 are perspective views of a paintball marker according to a preferred embodiment of this invention.
Figure 4:
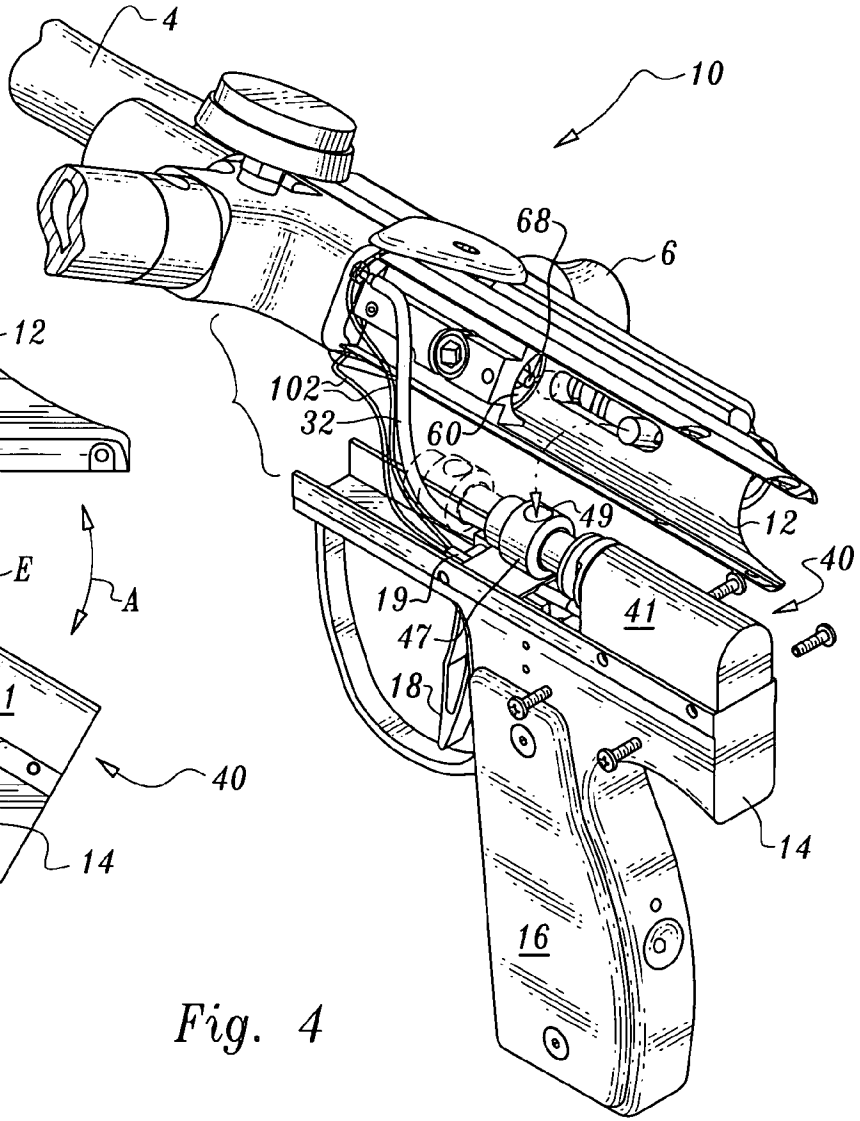
FIGS. 3 and 4 are perspective views of that which is shown in FIG. 1, but with a lower body portion and an upper body portion partially removed from each other such as when maintenance and troubleshooting is to occur on internal portions of the paintball marker.
Figure 3:
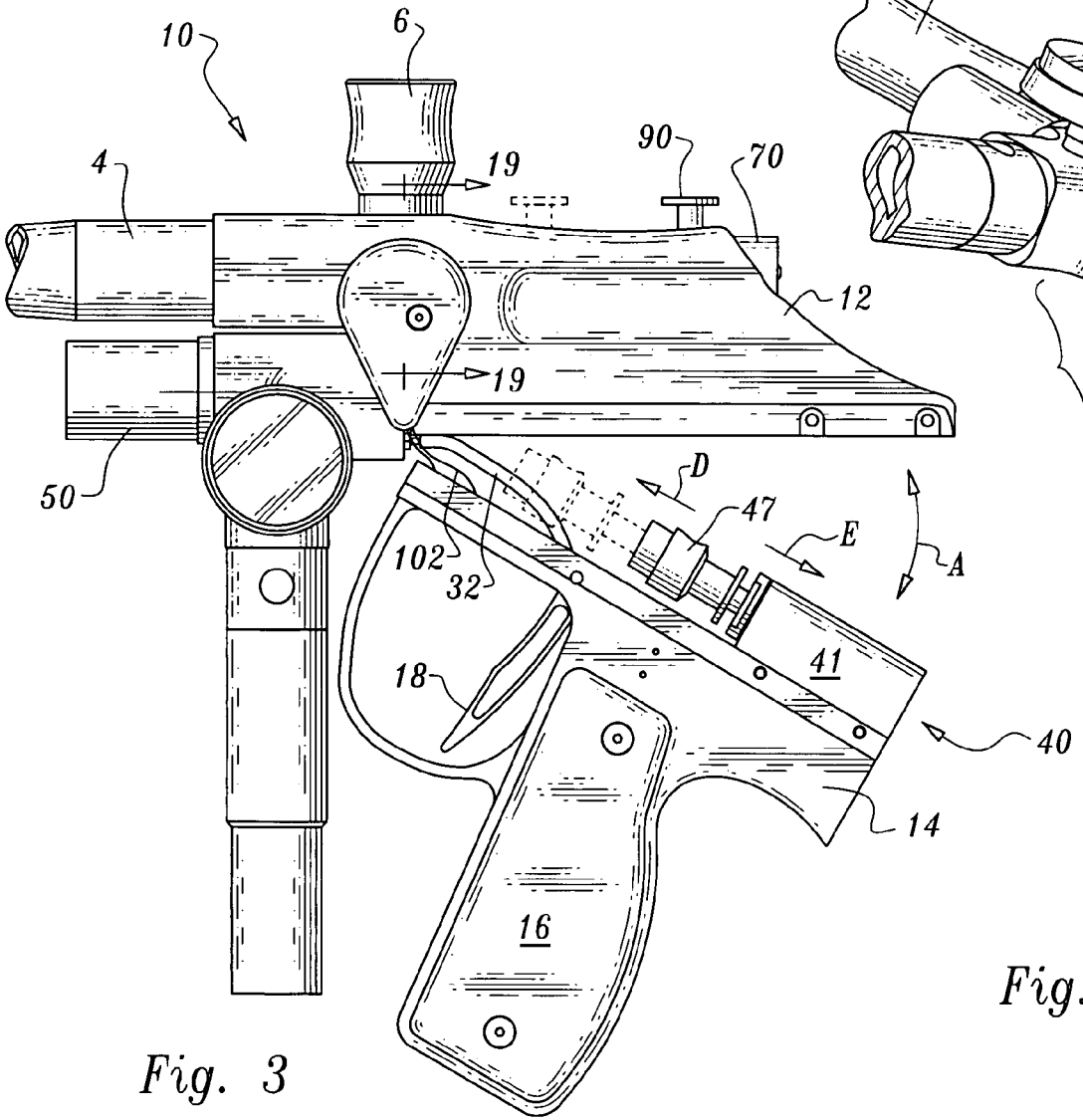
Figure 6:
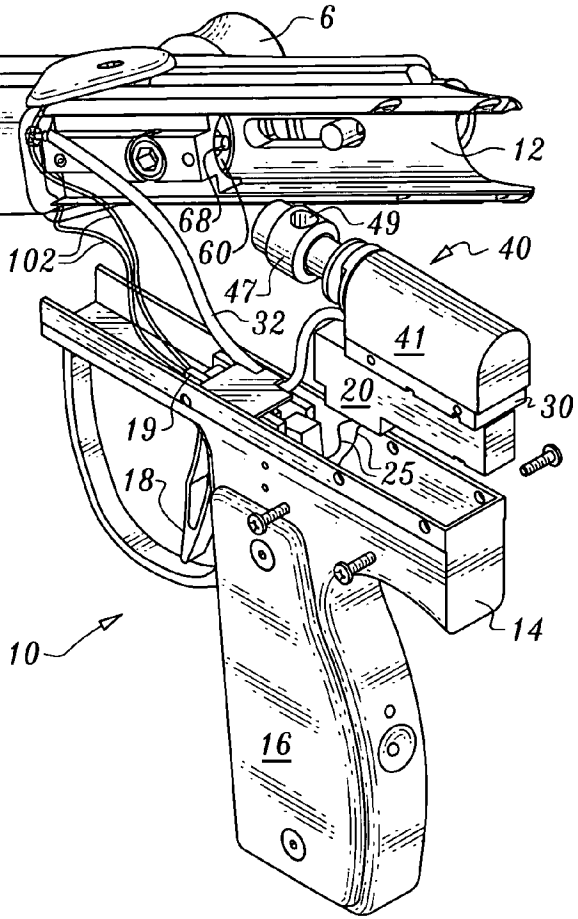
FIGS. 5 and 6 are perspective views of that which is shown in FIG. 1 with further disassembly of a ram assembly of the paintball marker from adjacent portions of the body of the paintball marker for troubleshooting and maintenance of the ram assembly.
Figure 5:
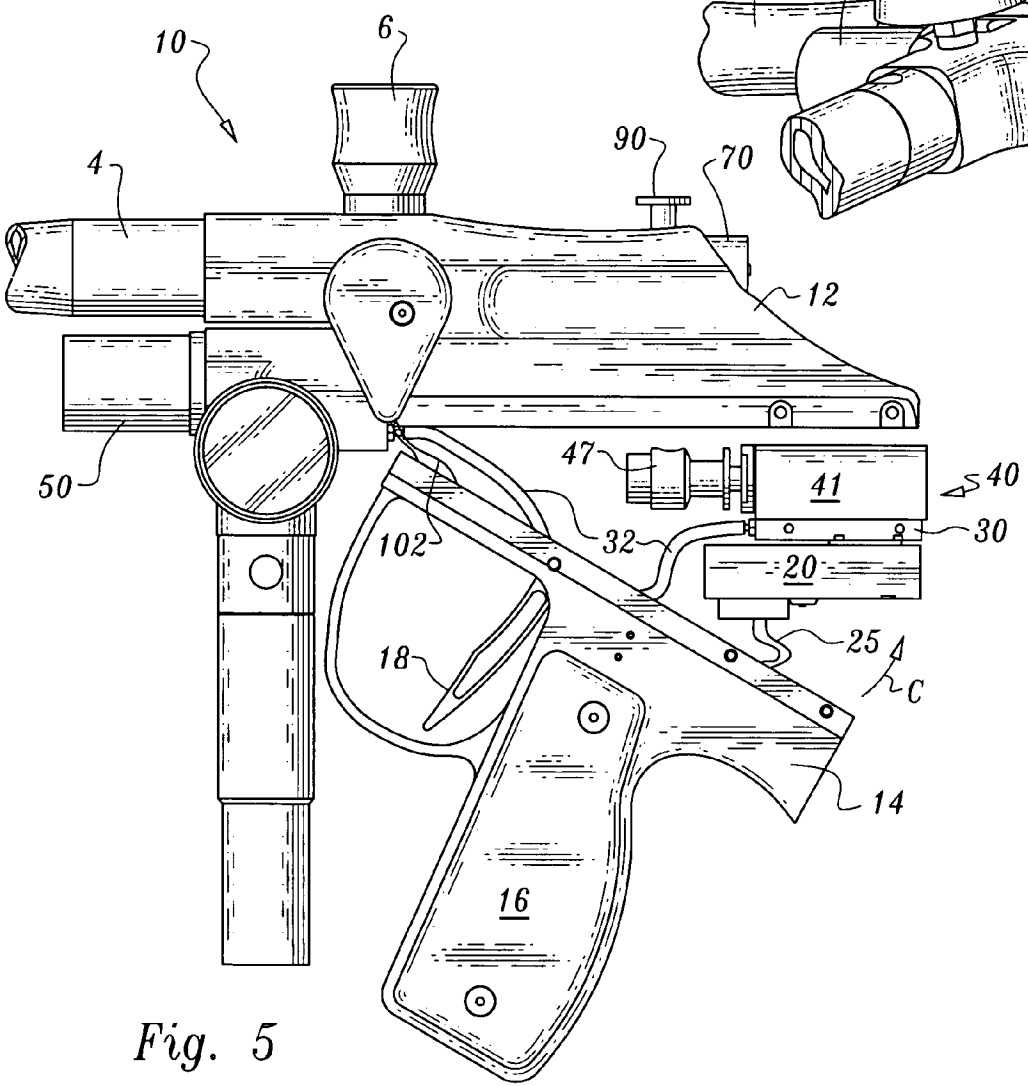

Referring to the drawings, wherein like reference numerals represent like parts throughout the various drawing figures, reference numeral 10 (FIGS. 1 and 2) is directed to a paintball marker according to a preferred embodiment of this invention. This paintball marker 10 is configured to cause air from an air supply 2 to be delivered to a firing chamber 8 (FIG. 7) for firing of a paintball B out of a barrel 4 and toward a target. Control of firing of the paintball marker 10 is provided by actuation of a trigger 18 which is operatively coupled to a main valve 60 (FIG. 7) to allow high pressure air to pass selectively from the air supply 2 up to the firing chamber 8 in response to actuation of the trigger 18.

In essence, and with particular reference to FIGS. 1-6, basic details of the paintball marker 10 are described. To cause the trigger 18 to open the main valve 60, preferably an electropneumatic valve 20 (FIGS. 5 and 6) is coupled to the trigger 18. The electropneumatic valve 20 has a manifold 30 adjacent thereto which feeds low pressure air into and out of the electropneumatic valve 20 and on to a ram assembly 40 adjacent the manifold 30. Low pressure air is supplied from a regulator 50 which takes high pressure air from the air supply 2 and reduces its pressure to feed the low pressure air to the manifold 30 and then to the electropneumatic valve 20 before delivery to the ram assembly 40. This low pressure air causes a position of the ram 40 to be modified (such as along arrows D and E of FIG. 4). The ram assembly 40 is configured to have a portion thereof selectively placable adjacent the main valve 60. When the ram 40 is moved by the electropneumatic valve 20 (caused by actuation of the trigger 18) the main valve 60 is caused to open so that high pressure air can pass from the air supply 2 to the main valve 60.

Figure 11:
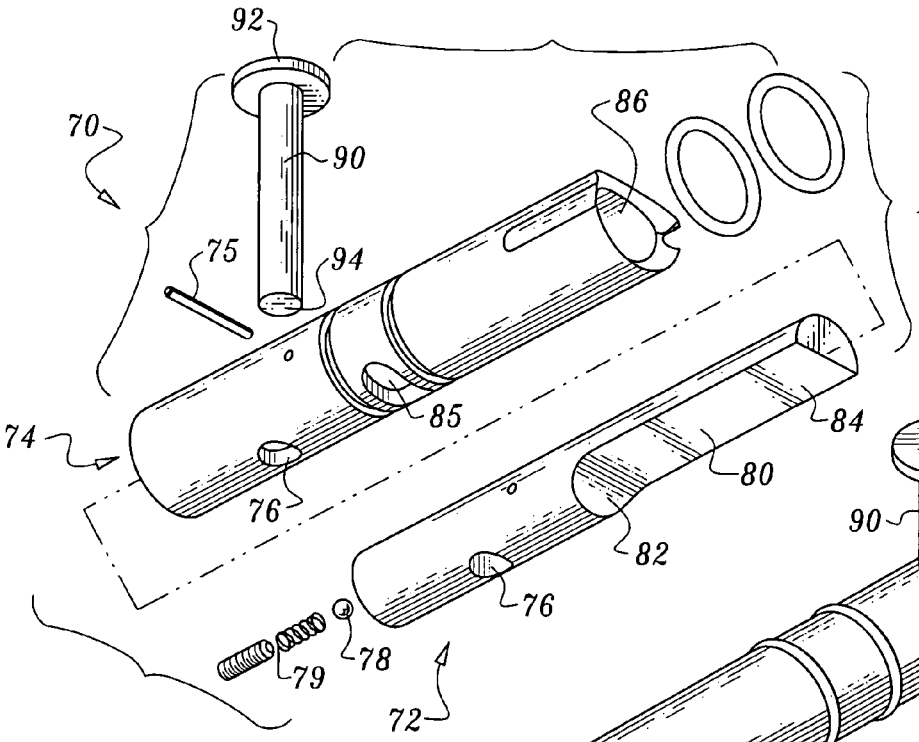
FIG. 11 is an exploded parts view of a bolt of this invention.
Figure 12:
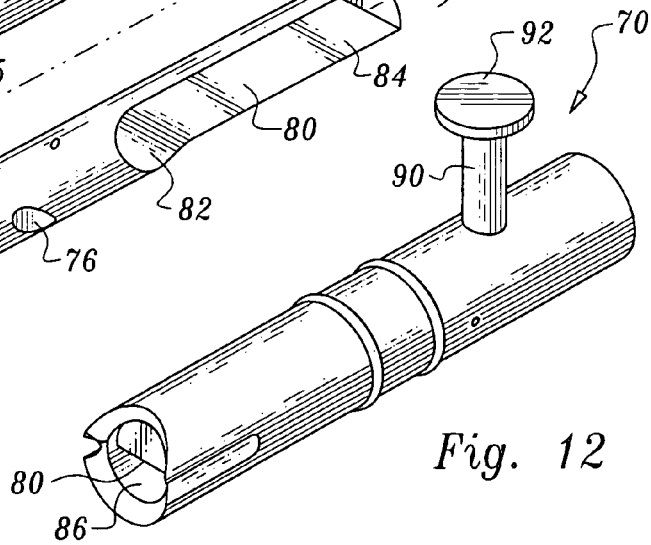
FIG. 12 is a perspective view of the bolt of FIG. 11 shown assembled.
Figure 13:
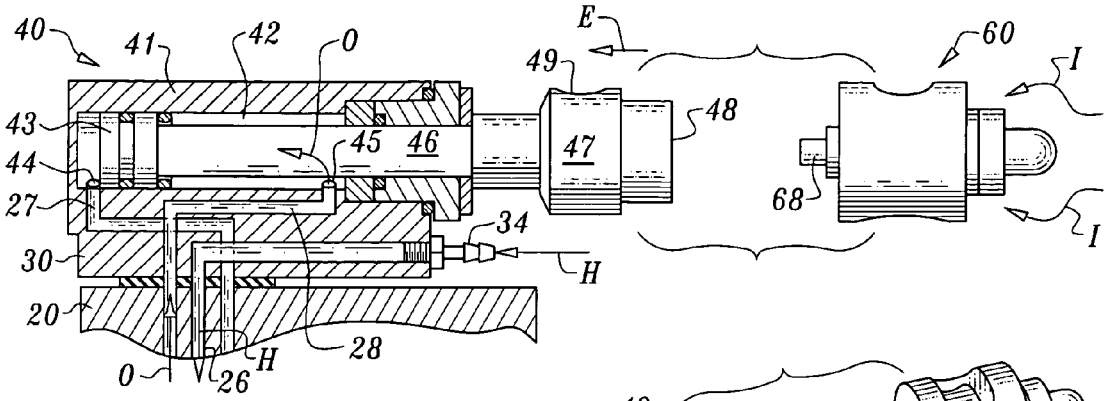
FIG. 13 is a side elevation view of a ram assembly and main valve of this invention with portions of the ram assembly cut away to reveal interior details.
Figure 14:
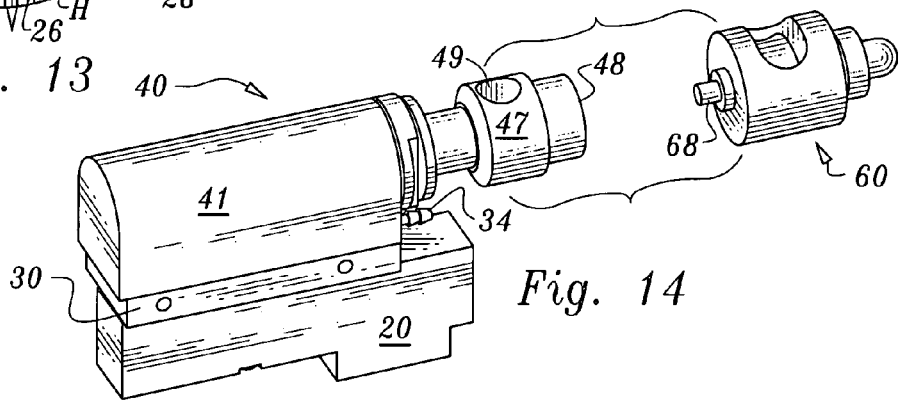
FIG. 14 is a perspective view of that which is shown in FIG. 13 without any portions cut away.
Figure 15:
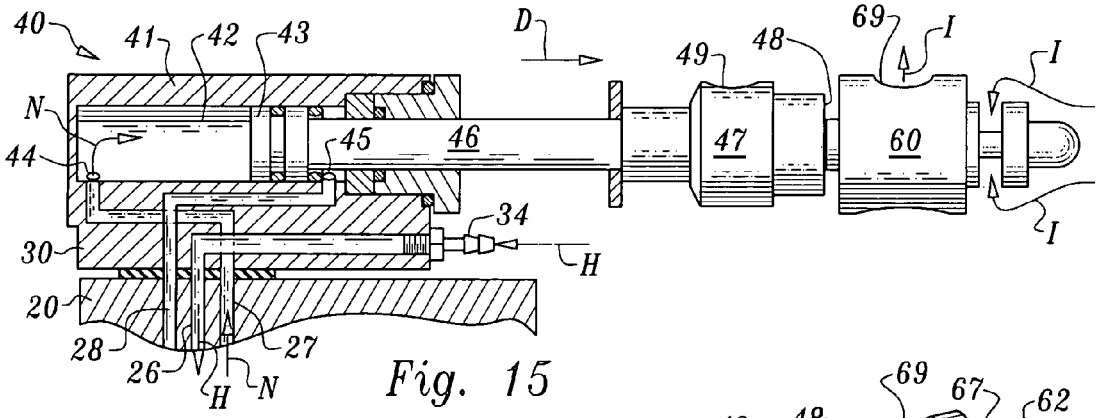
FIG. 15 is a side elevation view similar to FIG. 13 but with the ram transitioned to a position where a hammer of the ram is striking the main valve to actuate the main valve and cause high pressure air to travel through the main valve.
Figure 16:
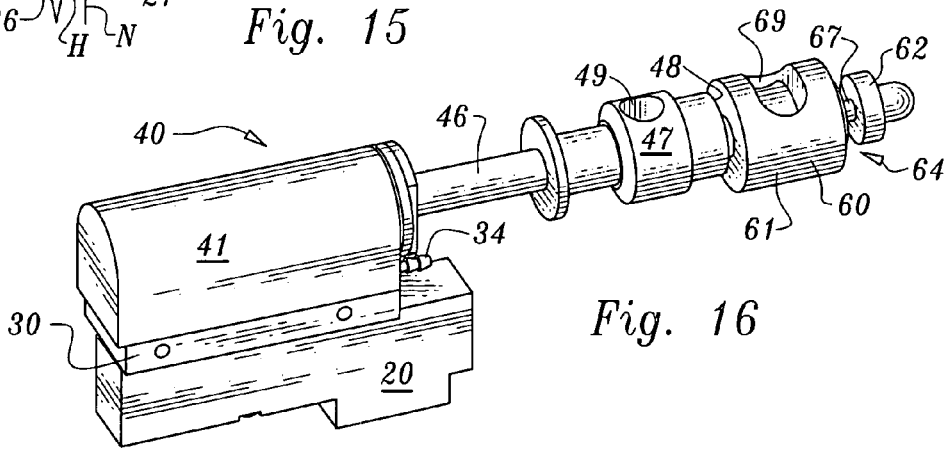
FIG. 16 is a perspective view of that which is shown in FIG. 15 with no portions of the ram assembly cut away.

The high pressure air passing through the main valve 60 is delivered up to a location adjacent a bolt 70 (FIGS. 10-12) with the bolt 70 defining a portion of a high pressure air pathway from the main valve 60 to the firing chamber 8. The bolt 70 is preferably aligned along a common line with the firing chamber 8 and the barrel 4. The bolt 70 includes a guide surface 80 which defines a portion of the bolt 70 against which high pressure air is routed to deliver the high pressure air to the firing chamber 8. This guide surface 80 is configured to be smooth and to effectively deliver the high pressure air to the firing chamber 8.

A post 90 is provided to removably couple the bolt 70 to portions of the ram 40 so that the bolt 70 moves with the ram 40. When the post 90 is removed, the bolt 70 can be removed, such as for cleaning of a bore 71 in which the bolt 70 and firing chamber 8 reside, and to facilitate operation of the ram 40 independent from the bolt 70 and main valve 60 in a partially disassembled configuration (FIGS. 3-6) for troubleshooting and maintenance on the ram 40 and other internal assemblies within the paintball marker 10.

Figure 19:
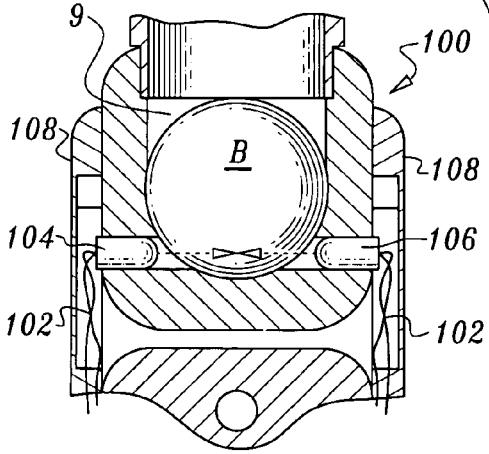
FIG. 19 is a full sectional view of a ball sensor assembly which is provided near a firing chamber of the marker to verify that a ball is in proper position before execution of a firing sequence.

A ball sensor 100 (FIGS. 19 and 20) is preferably provided to verify that a ball B is properly positioned below a feed tube 6 and directly behind the firing chamber 8. The ball sensor 100 is coupled to circuitry between the trigger 18 and the electropneumatic valve 20 so that a firing sequence is not initiated by the electropneumatic valve 20 unless the ball B is properly positioned for the firing sequence to be effective.

More specifically, and with particular reference to FIGS. 1-4, general portions of the paintball marker 10 which are shared with many prior art paintball markers are described. The paintball marker 10 is adapted to have an air supply 2 attached thereto preferably in the form of a canister fillable with compressed air or other gases. For instance, a port can be provided with threads thereon and which is complementally sized so that the air supply 2 can be threaded into this port and cause high pressure air to pass directly from the air supply 2 up into high pressure portions of the paintball marker 10 upstream from the main valve 60. This air supply 2 can take on many different forms depending on the volume of gas to be attached to the paintball marker 10. As an alternative, a compressed air hose could be coupled to the air supply 2 or some form of small air compressor could be coupled to the paintball marker 10 as an alternative form of air supply 2.

Figure 7:
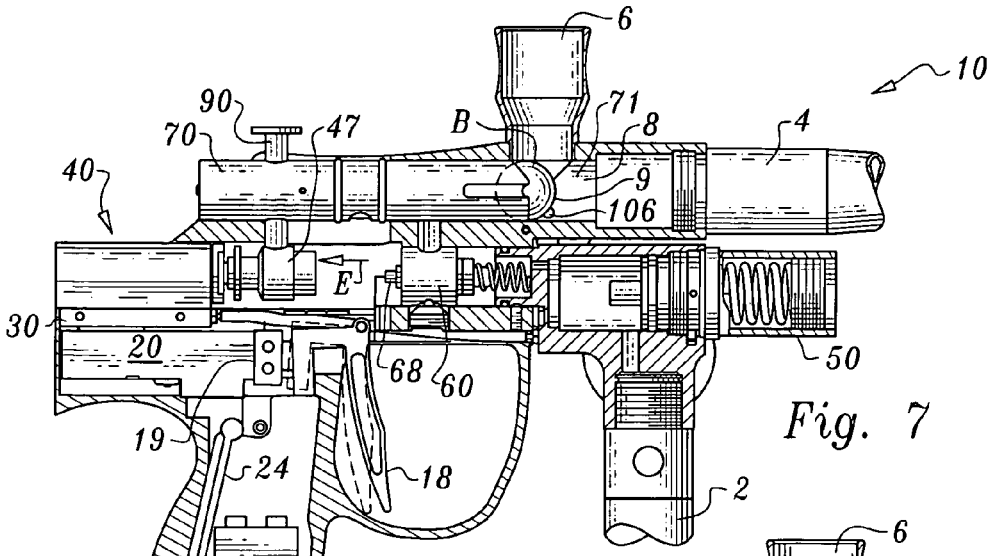
FIGS. 7-9 are sequential side elevation views of that which is shown in FIG. 1 with portions of the body cut away to reveal the relative orientation of subassemblies within the body of the paintball marker and their relative positions and interactions during the steps associated with causing the paintball marker to deliver a paintball therefrom.

The barrel 4 is a generally cylindrical hollow tube extending in an elongate fashion linearly from the firing chamber 8 (FIG. 7). The firing chamber 8 can be inside the barrel 4 or adjacent but outside the barrel 4. The barrel 4 can take on many different configurations including various different lengths and the inclusion of holes therein and other structures to influence ball B trajectory upon leaving the paintball marker 10, to influence noise generated by the paintball marker 10, and for other purposes common with barrels of firearms generally. The feed tube 6 preferably extends perpendicularly down into a prechamber near the firing chamber 8 but slightly to a side of the firing chamber 8 opposite the barrel 4. This feed tube 6 is preferably configured so that it can be coupled to a hopper in which multiple balls can be held until gravity fed through the feed tube 6 down into the prechamber 9.

The prechamber 9 is preferably cylindrical along with the firing chamber 8 and with a similar diameter and directly adjacent each other, but with the prechamber 9 on a side of the firing chamber 8 opposite the barrel 4 and closer to the bolt 70. A bore 71 preferably passes through the paintball marker 10 for supporting of the bolt 70, and defining both the prechamber 9 and firing chamber 8. Preferably, the barrel 4 threads into the paintball marker 10 so that the barrel 4 effectively extends the bore 71 entirely along a linear path through the paintball marker 10.

The paintball marker 10 preferably has the various different subcomponents thereof either attached to or contained within a body. This body preferably comes in two main portions including an upper body portion 12 and a lower body portion 14 (FIGS. 3-6). The upper body portion 12 and lower body portion 14 are configured so that they can be separated from each other, such as by pivoting along arrow A, to access internal structures for troubleshooting and maintenance. Preferably electrical and pneumatic connections between the upper body portion 12 and lower body portion 14 are contained within flexible conduits, such as wires or tubes so that the upper body portion 12 and lower body portion 14 can be separated from each other while the various different subassemblies remain fully functioning to the extent electrical or pneumatic "signals" are required between the different subassemblies.

The lower body portion 14 includes a grip 16 thereon configured to be readily held by a hand of a user. The trigger 18 is also mounted to the lower body portion 14. The trigger 18 is coupled to a switch 19 which converts physical motion of the trigger 18 into an electronic signal for use in actuating the electropneumatic valve 20. In particular, and with particular reference to FIG. 7, the trigger 18 and switch 19 are coupled to electronic circuitry including a battery 22 and a printed circuit board 24 through various different wires 25 (FIGS. 5 and 6) so that actuation of the trigger 18 causes an input into this electronic circuitry. Preferably, the printed circuit board 24 and battery 22 are contained within a hollow chamber within the grip 16 of the lower body portion 14.

With particular reference to FIGS. 13-16, details of the electropneumatic valve 20 and manifold 30 are described. The electropneumatic valve 20 and manifold 30 operate along with the ram assembly 40 to convert actuation of the trigger 18 into opening of the main valve 60 when appropriate for delivery of high pressure air to the firing chamber 8 and for firing of the ball B. In particular, the electropneumatic valve 20 includes a solenoid which can open and close various different low pressure air (or other gas) pathways passing between the electropneumatic valve 20 and the ram 40 through the manifold 30.

Preferably, the ball sensor 100 is coupled to the circuitry including the printed circuit board 24 and appropriate logic is programmed into an integrated circuit or other logic device so that the electropneumatic valve 20 does not operate when the ball B is not in proper position for launching of the ball B. When the ball B is in proper position as detected by the ball sensor 100, and when other criteria programmed into the logic of the circuitry are satisfied, and the trigger 18 is actuated, an electric signal is sent from the circuitry to the electropneumatic valve 20 causing the solenoid to move and for air to be delivered to one of two different paths from the electropneumatic valve 20 through the manifold 30 and to the ram 40.

In particular, the electropneumatic valve 20 includes an air in port 26 coupled to a port 34 in the manifold 30 which is in communication with the flexible air coupling 32 extending from a low pressure side of the regulator 50. The air in port 26 thus delivers low pressure air into the electropneumatic valve 20 on a supply side of the electropneumatic valve 20. The electropneumatic valve 20 is configured to have two outlets including a drive path 27 and a return path 28. The electropneumatic valve 20 can either be toggled through actuation of the solenoid to open the drive path 27 or to open the return path 28. The drive path 27 is coupled to pathways within the manifold 30 leading to a drive port 44 of the ram assembly 40. The return path 28 is configured to deliver high pressure air through the manifold 30 along appropriate pathways leading to a return port 45 of the ram assembly 40. Thus, when the electropneumatic valve 20 is appropriately signaled, it causes delivery of air to either the drive path 27 or the return path 28 for operation of the ram 40.

The electropneumatic valve 20 and manifold 30 are preferably coupled directly to the ram assembly 40 so that relative motion between the electropneumatic valve 20, manifold 30 and ram 40 is precluded. As an alternative, the various different pathways between the electropneumatic valve 20, the manifold 30 and the ram 40 could occur along flexible couplings, such as air tubes, so that the electropneumatic valve 20, manifold 30 and ram 40 could all be structured to move somewhat independently of each other. It is also conceivable that the electropneumatic valve 20, manifold 30 and/or ram 40 could be more completely integrated so that they are formed together as a single assembly, rather than merely being separate structures fixed to each other with fasteners.

With continuing reference to FIGS. 13-16, details of the ram assembly 40 are described. The ram assembly 40 is preferably provided as a separate assembly contained within the body of the paintball marker 10 and interacting with various different structures including the main valve 60 and bolt 70 of the paintball marker 10 when actuated by the electropneumatic valve 20, such as when the trigger 18 is actuated. The ram 40 can thus be removed from other portions of the paintball marker 10, such as by movement along arrow C (FIG. 5) while the ram assembly 40 remains operatively coupled to the electropneumatic valve 20, manifold 30 and the source of low pressure air and wiring necessary to allow the ram assembly 40 to function even when partially removed from other portions of the paintball marker 10. The ram assembly 40 includes the housing 41 generally in the form of a chamber with a cylindrical bore 42 therein, and with the housing 41 also including a cap to close off this bore 42 so that air is effectively trapped within the bore 42. A piston 43 resides within the bore 42 and is adapted to slide within the bore 42. While the ram 40 is preferably configured to operate to move the piston 43 in a linear fashion, it is conceivable that the ram 40 could be modified to allow the piston 43 to travel along an arcuate path or to rotate rather than translating linearly.

The bore 42 includes a drive port 44 and a return port 45 on opposite sides of the piston 43 and at opposite ends of the bore 42. The drive port 44 is coupled to the drive path 27 of the electropneumatic valve 20 and the return port 45 is coupled to the return path 28 of the electropneumatic valve 20. When low pressure air is supplied through the return port 45 into the bore 42, the piston 43 of the ram assembly 40 is caused to translate linearly away from the return port 45 and causing a shaft 46 coupled to the piston 43 to be retracted. Such motion is particularly shown in FIG. 13 with air flow along arrow O pushing the piston 43 and associated shaft 46 to cause retraction of a hammer 47 of the ram assembly 40 along arrow E. This in turn blocks flow of high pressure air along arrow I through the main valve 60.

When low pressure air is fed through the drive port 44 the reverse takes place. Particularly, air flow along arrow N passes through the drive port 44 and into the bore 42 to drive the piston 43 away from the drive port 44 so that the drive shaft 46 extends out of the bore 42 pushing the hammer 47 (along arrow D of FIG. 15) into contact with the main valve 60 to open the main valve 60 and allow high pressure air flow I through the main valve 60. Low pressure air flow H feeds the electropneumatic valve 20 and supplies both the return port 45 and drive port 44 with air to move the piston 43 and associated shaft 46 of the ram assembly 40. Appropriate seals are provided on the piston 43 and cap of the housing 41 so that air is prevented from leaking out of the bore 42 while the piston 43 is allowed to move within the bore 42 and the shaft 46 is allowed to slide into and out of the bore 42 through the cap of the housing 41.

The hammer 47 of the ram 40 is preferably merely an enlarged portion of an end of the shaft 46, with the hammer 47 being optionally replaced by an end or mid portion of the shaft itself. The hammer 47 includes a face 48 (FIGS. 13-16) which is adapted to strike a pin 68 on the main valve 60 to cause the main valve 60 to open. Such contact does not occur when the ram assembly 40 is removed from the body of the paintball marker 10 as shown in FIGS. 3-6. Thus, the ram assembly 40 can be fully tested without causing the main valve 60 to open during such testing. The hammer 47 or shaft 46 can be coupled to the man valve 60 in ways other than striking contact, such as with mechanical links or other couplings.

The hammer 47 includes a hole 49 preferably extending into said hammer 47 in a direction perpendicular to a long axis of the shaft 46. This hole 49 is sized to receive the post 90 of the bolt 70 for selectively securing the hammer 47 of the ram assembly 40 to the bolt 70. When the post 90 is removed, the ram assembly 40 can be tested without causing the bolt 70 to move. Also, such disconnecting between the bolt 70 and ram 40 facilitates removal of the bolt 70 out of the body of the paintball marker 10, such as when cleaning of the bore 71, firing chamber 8, prechamber 9 and barrel 4 is desired.

Figure 10:
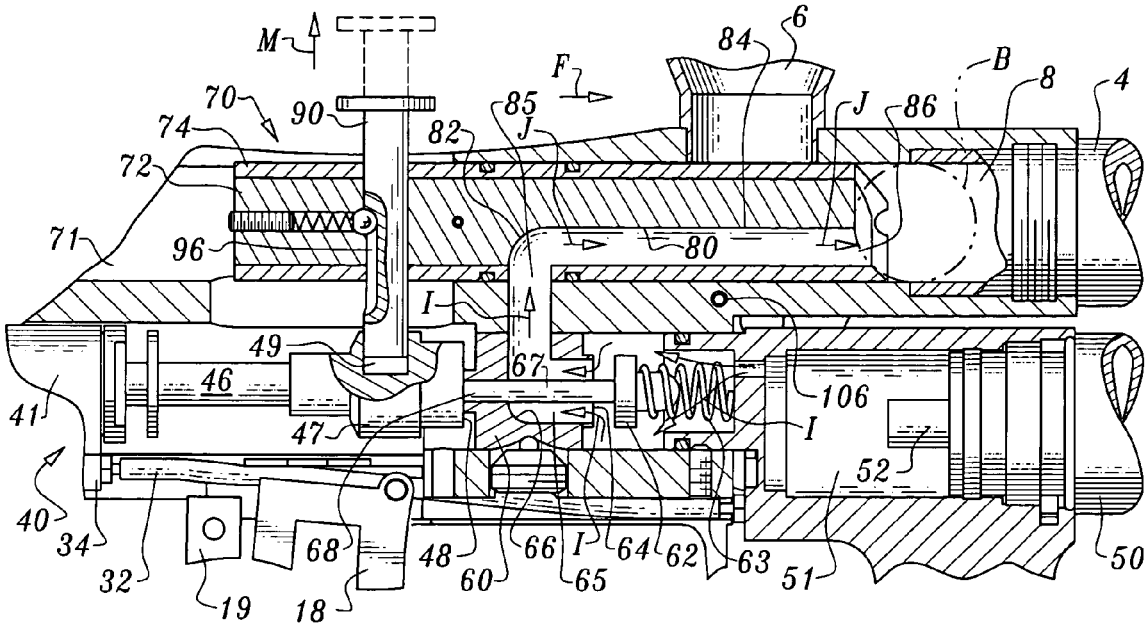
FIG. 10 is a detail of that which is shown in FIG. 9 with further portions thereof cut away and with arrows particularly indicating a high pressure air pathway through the paintball marker from a high pressure air source to a firing chamber for launching of a paintball.
Figure 17:
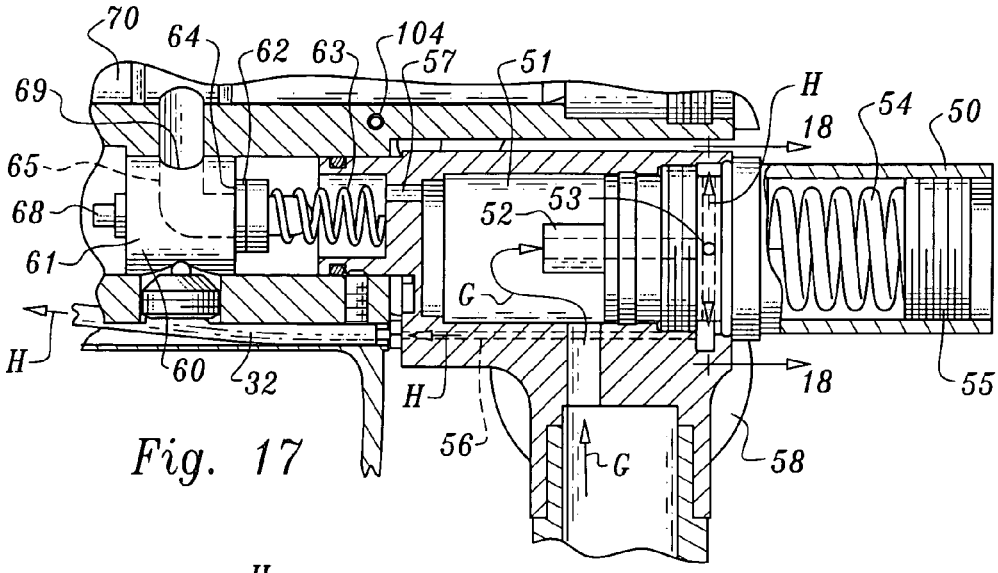
FIG. 17 is a side elevation view of a portion of the high pressure air pathway between the high pressure air source and the main valve with portions of the body and other structures cut away to reveal in detail the flow pathway for the high pressure air, as well as details of a regulator for providing low pressure air to control the ram assembly according to this invention.
Figure 18:
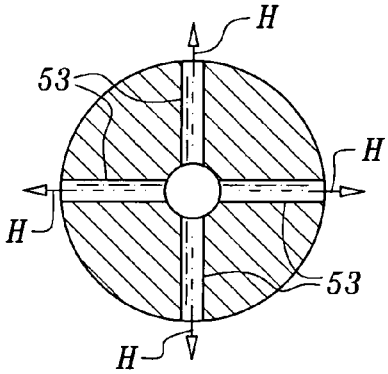
FIG. 18 is a sectional view taken along line 18-18 of FIG. 17 showing how low pressure air is routed toward the ram assembly.
Figure 20:
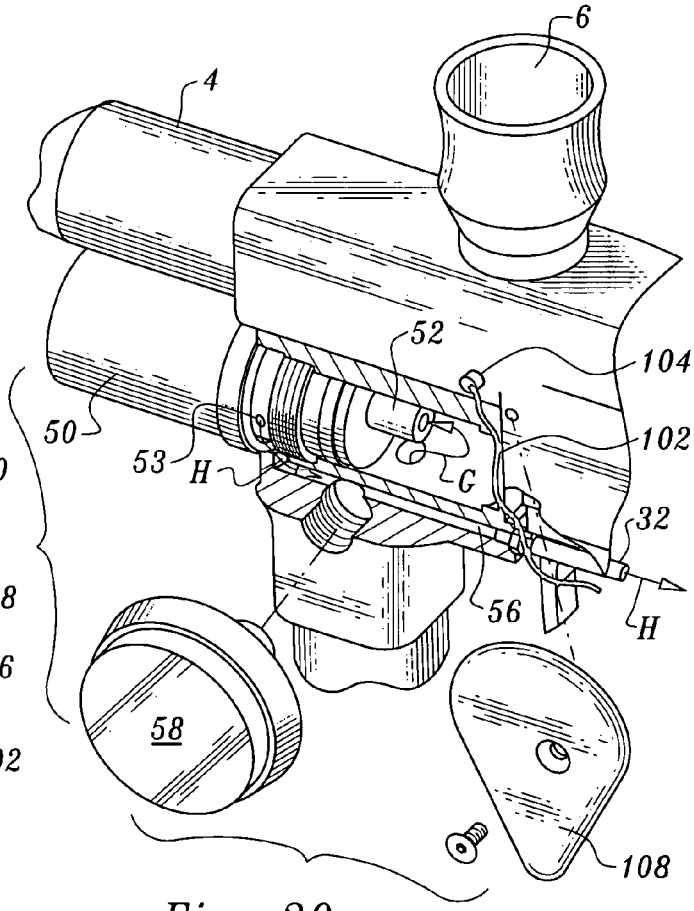
FIG. 20 is a perspective view of a portion of that which is shown in FIGS. 1 and 2 revealing further details of the high pressure air pathway and low pressure air pathway, as well as wiring for the ball sensor for the marker of this invention.
Figure 21:
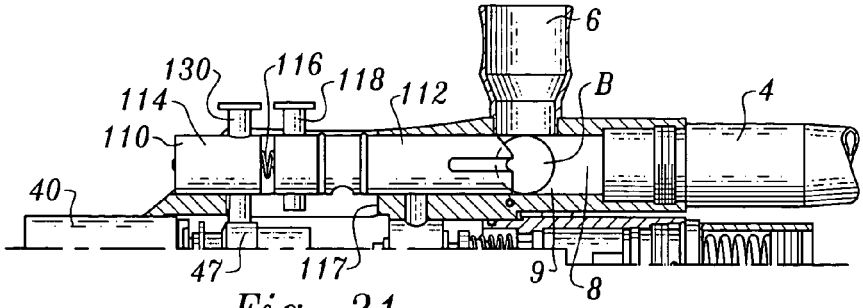
FIGS. 21-23 show side elevational views of an alternative embodiment of the paintball marker of FIG. 1, with these sequential views similar to the views of FIGS. 7-9 except that the bolt of the preferred embodiment has been replaced with a compound bolt, and with portions of the body and other structures cut away to reveal interior details of the marker and compound bolt according to this alternative embodiment.

With particular reference to FIGS. 10, 17 and 20, particular details of the regulator 50 and portions of the high pressure air pathway upstream of the main valve 60 are described. The regulator 50 is provided according to the preferred embodiment to control a level of pressure of the high pressure air pathway, as well as to provide low pressure air for the electropneumatic valve 20. It is conceivable that the electropneumatic valve 20 could be modified to be operated on high pressure air, as well as for the ram 42 to be operated on high pressure air, and for the regulator 50 to be dispensed with. However, it is desirable to have the additional control associated with the regulator 50 and the relatively low pressures required to drive the ram 40 through the electropneumatic valve 20 can beneficially best be provided with lower pressure air such as can be provided by the regulator 50.

The regulator 50 is preferably located within a chamber 51 in the upper body 12 of the paintball marker 10. This chamber 51 is downstream from the air supply 2 and upstream of the main valve 60. The regulator 50 includes an inlet 52 which feeds low pressure outlet paths 53 to deliver air (along arrow H) to the electropneumatic valve 20. A pressure control spring 54 is located within the regulator 50 which includes an adjustment screw 55 for adjusting of the pressure control spring 54.

The low pressure outlet paths 53 are in the form of various paths extending radially to an annular portion which feeds a low pressure tunnel 56 passing through the upper body and feeding an end of the flexible air coupling 32 which then extends on to the manifold 30 and electropneumatic valve 20. A low pressure gauge 58 is preferably located along the low pressure tunnel 56 (FIG. 20) so that the low pressure gauge 58 can show that the regulator 50 is operating properly and that maximum pressures are not being exceeded for operation of the electropneumatic valve 20 and ram 40.

The regulator 50 also includes a high pressure outlet 57 through which high pressure air is delivered to an upstream side of the main valve 60. High pressure air flow from the air supply 2, along arrow G (FIG. 17) feeds the inlet 52 leading to the low pressure outlet paths 53 as well as feeding the high pressure outlet 57. The regulator 50 can be configured to moderate the high pressure between the air supply 2 and the high pressure outlet 57, or the regulator 50 can be provided merely to deliver low pressure air to the low pressure outlet paths 53 feeding the manifold 30 and electropneumatic valve 20.

With particular reference to FIGS. 10 and 17, details of the main valve 60 are provided. The main valve 60 controls the high pressure air pathway from the air supply 2 to the firing chamber 8. When the main valve 60 opens, high pressure air is supplied to the firing chamber 8 for firing of the ball B. When the main valve 60 is closed, the high pressure air pathway is blocked.

The main valve 60 includes a body 61 with an air pathway 65 passing therethrough. A plate 62 is provided adjacent the body 61 with a spring 63 abutting the plate 62 and pressing the plate 62 against the body 61 overlying an entrance 64 feeding the air pathway 65 of the body 61. The spring 63 keeps the plate 62 in position blocking the entrance 64 to the air pathway 65 except when the spring 63 is compressed and the plate 62 is moved off of the entrance 64 to allow high pressure air flow into the air pathway 65.

The air pathway 65 preferably bends 90° at a curve 66 within the body 61 between the entrance 64 and an outlet 69 from the main valve 60. This curve 66 is preferably gradual, such as having a radius of curvature similar to a radius of the air pathway 65 itself and a radius of the entrance 64 and the outlet 69. The curve 66 can be made even more gradual, such as by having a radius of curvature similar to a width of the air pathway 65 and the outlet 69 and entrance 64. By making the curve 66 gradual, turbulence is minimized and the air is most effectively redirected perpendicularly between the entrance 64 and the outlet 69.

A shaft 67 is coupled to the plate 62 and extends through the body 61 to the pin 68. The pin 68 is in position to be struck by the hammer 47 or the ram 40 so that the ram 40 can cause the shaft 67 to move, and for the plate 62 coupled to the shaft 67 to move off of the entrance 64 so that high pressure air can pass through the main valve 60 along the air pathway 65.

While the spring 63 is shown external to the body 61 of the main valve 60, it is conceivable that the spring 63 could be located inside the body 61 of the main valve 60, such as by configuring the spring 63 as a tension spring rather than as a compression spring. The main valve 60 is positioned so that the outlet 69 is directly below and near the bore 71 in which the bolt 70 resides, so that high pressure air can be fed up to the bore 71 and on to the firing chamber 8 along a surface of the bolt 70 during firing.

With particular reference to FIGS. 7-12, particular details of the bolt 70 and portions of the high pressure air pathway between the main valve 60 and the firing chamber 8 are described. The bolt 70 resides within the cylindrical bore 71 which is preferably aligned with the prechamber 9, firing chamber 8 and barrel 4. Preferably, this alignment is parallel with the entrance 64 into the main valve 60 but with air flow preferably reversed 180° between the entrance 64 of the main valve 60 and the firing chamber 8. While the main valve 60 rotates this flow 90°, the bolt 70 assists in redirecting the high pressure air 90° and toward the firing chamber 8. In particular, the bore 71 includes a hole directly above the main valve 60 which allows high pressure air to be fed from the main valve 60 into the bore 71.

The bolt 70 is preferably configured in two pieces including a core 72 and a sleeve 74. The core 72 is cylindrical in form and the sleeve 74 is cylindrical and hollow. The sleeve 74 is adapted to have the core 72 slid snugly into the sleeve 74. A coupling pin 75 is provided to secure the core 72 to the sleeve 74. A post receiver 76 passes through both the core 72 and sleeve 74 in a direction perpendicular to a long axis of the bolt 70. The post receiver 76 is sized to receive the post 90 therethrough and allow the post 90 to be removably attached to the bolt 70 and extend down from the bore 71 to the hammer 47 of the ram assembly 40.

Preferably, the post 90 is somewhat captured within the post receiver 76 of the bolt 70 by providing a retainer ball 78 and adjustable spring and set screw combination 79 to hold the pin 90 in position within the post receiver 76. When sufficient upward force (along arrow M of FIG. 10) is exerted upon the post 90, the post 90 can be removed form the post receiver 76 of the bolt 70, so that the post 90 can be removed from the bolt 70. By reversing this procedure, the post 90 can be reinserted through the post receiver 76 and into the bolt 70, and causing the bolt 70 to be recoupled to the ram assembly 40.

The core 72 is preferably modified on a lower and forward portion thereof to include a guide surface 80 defining one side of the high pressure air pathway between the main valve 60 and the firing chamber 8. This guide surface 80 works along with surfaces of the sleeve 74 to surround the high pressure air pathway between the main valve 60 and the firing chamber 8. The guide surface 80 includes a main curve 82 directly above the main valve 60. This main curve 82 causes the high pressure air pathway to rotate 90° and to cause the high pressure air flow to be directed toward the firing chamber 8.

Preferably, this main curve 82 is sufficiently gradual to avoid excessive turbulence and to effectively redirect the high pressure air flow. In particular, the main curve 82 is preferably at least as gradual as the curve within the main valve 60, such as by providing the main curve 82 with a radius of curvature not less than a radius of the outlet 69 of the main valve 60 and similar to a radius of an inlet 85 formed in the sleeve 74 to allow the high pressure air to pass through the sleeve 74 and against the main curve 82 and guide surface 80.

The guide surface 80 additionally includes an overhang 84 which is preferably substantially planar and extends from the main curve 82 to an outlet 86 adjacent the prechamber 9 or firing chamber 8, depending on the particular position of the bolt 70. The high pressure air path along the guide surface 80 and through the bolt 70 exhibits a crescent shape (FIG. 12) in cross section beneath the guide surface 80 and extending to the outlet 86. The guide surface 80 can optionally stop short of the bolt outlet 86, with the surface 80 preferably extending at least half of the distance and most optimally substantially all of the distance from the main curve 82 to the outlet 86.

The overhang 84 of the guide surface 80 is preferably near a centerline of the core 72 of the bolt 70. However, the overhang 84 is preferably slightly below this centerline. Portions of the sleeve 74 adjacent the outlet 86 are preferably curved so that the ball B can be located directly adjacent the sleeve 74. The high pressure air thus strikes the ball B near a center of the ball B, but slightly below a center of the ball B. Experience has shown that such a configuration for the high pressure air pathway directly adjacent the ball B is particularly effective in delivering the ball B precisely to targets a considerable distance away. The guide surface 80 of the bolt 70 thus effectively redirects the high pressure air from passing vertically along arrow I to passing horizontally along arrow J to impact the ball B.

The post 90 is preferably configured to include a head 92 opposite a tip 94 and with a notch 96 extending along a side of the post 90 near where the post 90 is located adjacent the retainer ball 78. The head 92 facilitates a user in grabbing the post 90 and manually adjusting a position of the post 90 vertically when desired.

Figure 8:
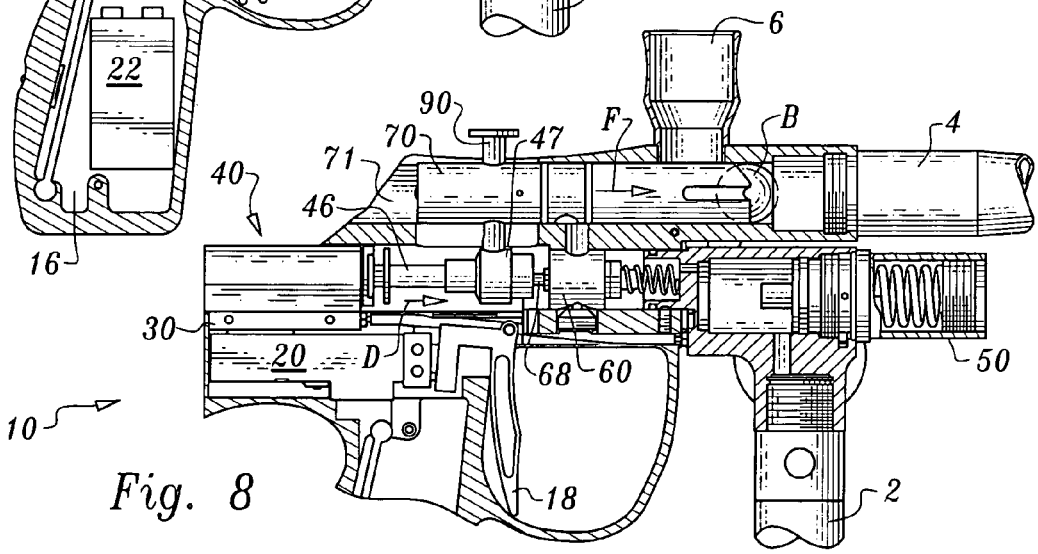
Figure 9:
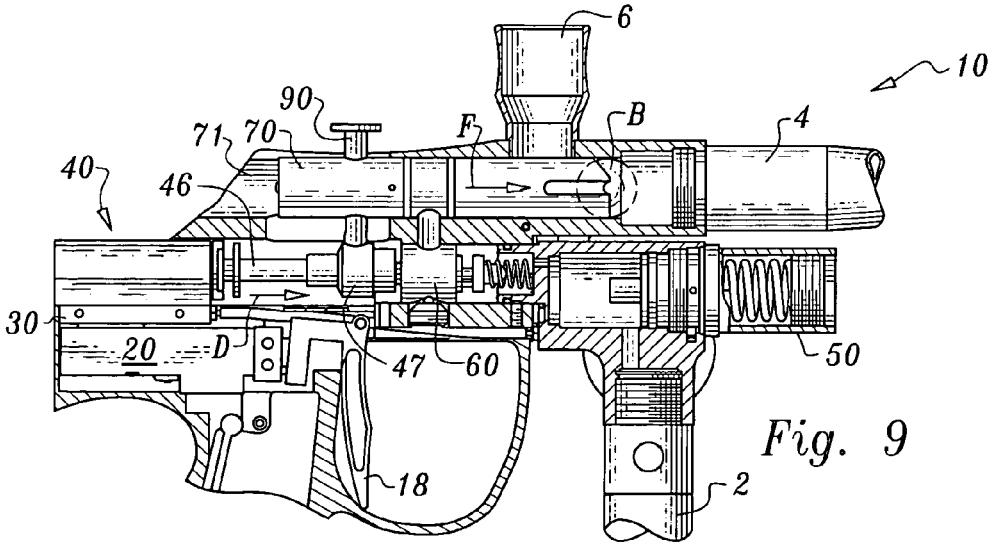

While the bolt 70 has been previously described in its capacity to redirect high pressure air from the main valve 60 to the firing chamber 8, the bolt 70 additionally preferably operates to close off a rear side of the bore 71 and rear side of the firing chamber 8, as well as to advance the ball B from the prechamber 9 to the firing chamber 8 and to close off the feed tube 6 before the firing sequence is initiated. In particular, and as shown in FIGS. 7-9, the sequence of firing the paintball B is described. Initially, low pressure air acts through the electropneumatic valve 20 to cause the ram assembly 40 to have the hammer 47 retracted (along arrow E). This in turn causes the bolt 70 to move away from the firing chamber 8. When the bolt 70 is moved sufficiently rearwardly, a ball within the feed tube 6 can fall down into the prechamber 9. The ball B is now in position within the bore 71.

The ball sensor 100 can be utilized to verify that the ball B is indeed in proper position within the prechamber 9. In particular, and with reference to FIGS. 19 and 20, the ball sensor 100 is preferably an electro-optical sensor which includes a light emitter 104 and a light sensor 106 each coupled by wires 102 to the circuitry on the printed circuit board 24. If the sensor 106 detects light, the ball B is not in proper position. If the sensor 106 does not detect light, the ball B is in proper position and the firing sequence can proceed. Preferably, a pair of cover plates 108 are provided to cover the wires 102 and to enhance a decorative appearance of the paintball marker 10. Other forms of ball position sensors could alternatively be provided.

With continuing reference to FIG. 7, the trigger 18 can then be toggled, causing the switch 19 to generate an electrical signal indicating to the circuitry on the printed circuit board 24 that launch of a paintball B is authorized. A signal is sent to the electropneumatic valve 20 causing low pressure air to be directed to the drive path 27 (FIGS. 13-16) so that the ram assembly 40 is operated, driving the hammer 47 forward (along arrow D). This simultaneously causes the bolt 70 to advance within the bore 71, causing the ball B to be advanced from the prechamber 9 to the firing chamber 8.

When the hammer 47 has advanced to the point where it contacts the pin 68 on the main valve 60, the inlet 85 in the sleeve 74 of the bolt 70 has come into alignment with the hole above the outlet 69 of the main valve 60. Further movement of the hammer 47 against the pin 68 causes the main valve 60 to open, allowing high pressure air to pass up out of the outlet 69 of the main valve 60, through the hole and into the inlet 85 within the bolt 70.

This high pressure air is then directed along the guide surface 80 to the firing chamber 8 where it impacts the ball B and drives the ball B out of the barrel 4. Such motion of the bolt 70 (along arrow F of FIGS. 8 and 9) thus both advances the ball B into the firing chamber 8, aligns the inlet 85 with the outlet 69 and causes portions of the sleeve 74 of the bolt 70 to block the feed tube 6 so that high pressure air is prevented from passing into the feed tube 6, and precluding further interference of other balls with the launching of the ball B from the barrel 4. This sequence is then repeated shortly thereafter by having the electropneumatic valve 20 switch to cause delivery of return air to the ram so that the hammer 47 cycles back (along arrow E of FIG. 7) and retracting the bolt 70 as shown in FIG. 7.

With particular reference to FIGS. 21-26, details of a compound bolt 110 according to an alternative embodiment of this invention are described. This compound bolt 110 can essentially be substituted for the bolt 70 without modification of other structures and subassemblies of the paintball marker 10 of the preferred embodiment. The compound bolt 110 includes two portions including a forward portion 112 and a rearward portion 114 which are each generally similar to forward and rearward portions of the bolt 70, except that the forward portion 112 and rearward portion 114 are separated from each other. A spring 116 or other bias is preferably interposed between the forward portion 112 and rearward portion 114 so that these portions 112, 114 are connected together, but are capable of limited motion independently from one another.

A stop surface 117 is contained within the body of the paintball marker 10 directly below the bore 71 and on a portion of the bore 71 preferably slightly forward of a cavity in which the hammer 47 of the ram assembly 40 resides. This stop surface 117 is positioned to interact with a stop post 118 passing through a rearward portion 114 of the compound bolt 110. The stop post 118 fits within a forward hole 119 in the forward portion 112 of the compound bolt 110. This stop post 118 is similar to the post 90, except that it is not coupled to the hammer 47, but rather is provided to stop motion of the forward portion 112 when the stop post 118 comes into contact with the stop surface 117. It is conceivable that the stop post 118 could be replaced by some other form of structure on the forward portion 112 that extends radially from the centerline of the bolt 110 sufficient to abut the stop surface 117. This structure could be an annular ring, or some other strong element extending laterally from the bolt 110.

The forward portion 112 includes a guide surface 120 generally similar to the guide surface 80 and including a main curve 122, overhang 124, inlet 125 and outlet 126 each analogous to the guide surface 80 of the preferred embodiment. A drive post 130 is provided passing through the rearward portion 114 of the compound bolt 110. This drive post 130 is movably coupled to the hammer 47 and functions similar to the post 90 of the preferred embodiment. Hence, the drive post 130 causes the rearward portion 114 of the compound bolt 110 to move with the hammer 47 of the ram 40. The forward portion 112 of the compound bolt 110 either moves along with the rearward portion 114 or is stopped by impacting of the stop post 118 against the stop surface 117 so that the forward portion 112 is stationary, even though the rearward portion 114 is still moving somewhat.

The forward portion 112 and rearward portion 114 are configured to allow relative motion therebetween only for a distance similar to an amount of travel required by the hammer 47 against the pin 68 of the main valve 60 to cause the main valve 60 to open. With the compound bolt 110 configured as described above, the compound bolt 110 provides the advantage that the guide surface 120 and other parts of the forward portion 112 of the compound bolt 110 are stationary when the main valve 60 opens and high pressure air passes along the guide surface 120 and on to the firing chamber 8.

Figure 22:
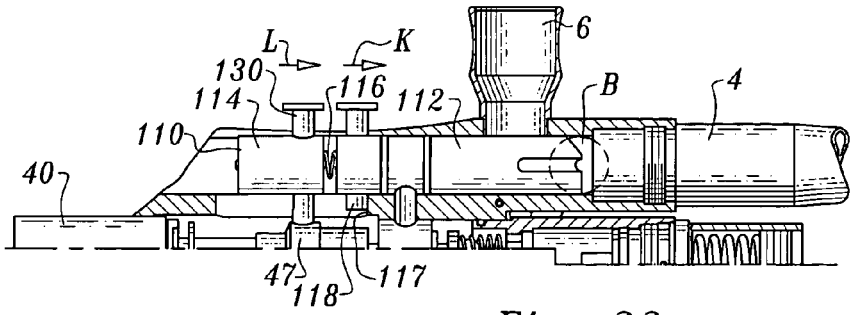
Figure 23:
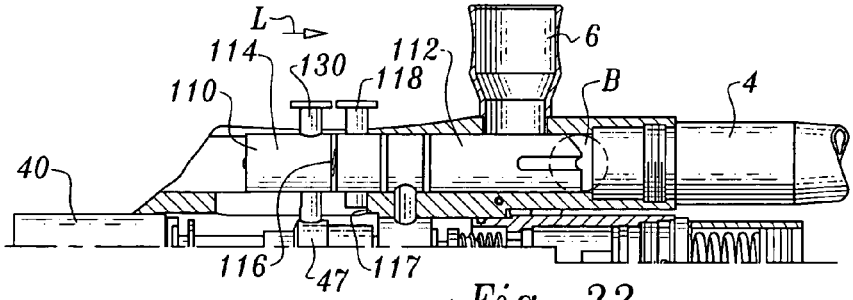
Figure 24:
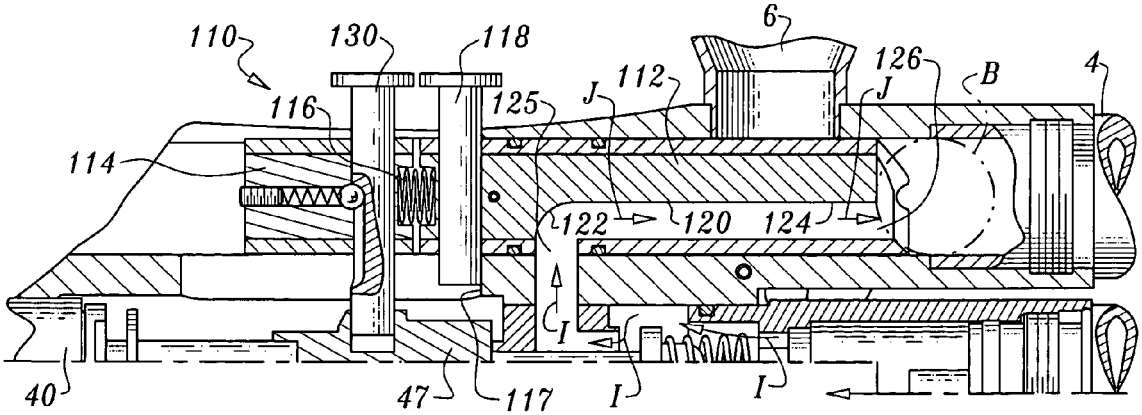
FIG. 24 is a detail of a portion of that which is shown in FIG. 23 and particularly showing a route of the high pressure air through the marker and the compound bolt, and with portions of the compound bolt cut away to further reveal this high pressure air pathway.
Figure 25:
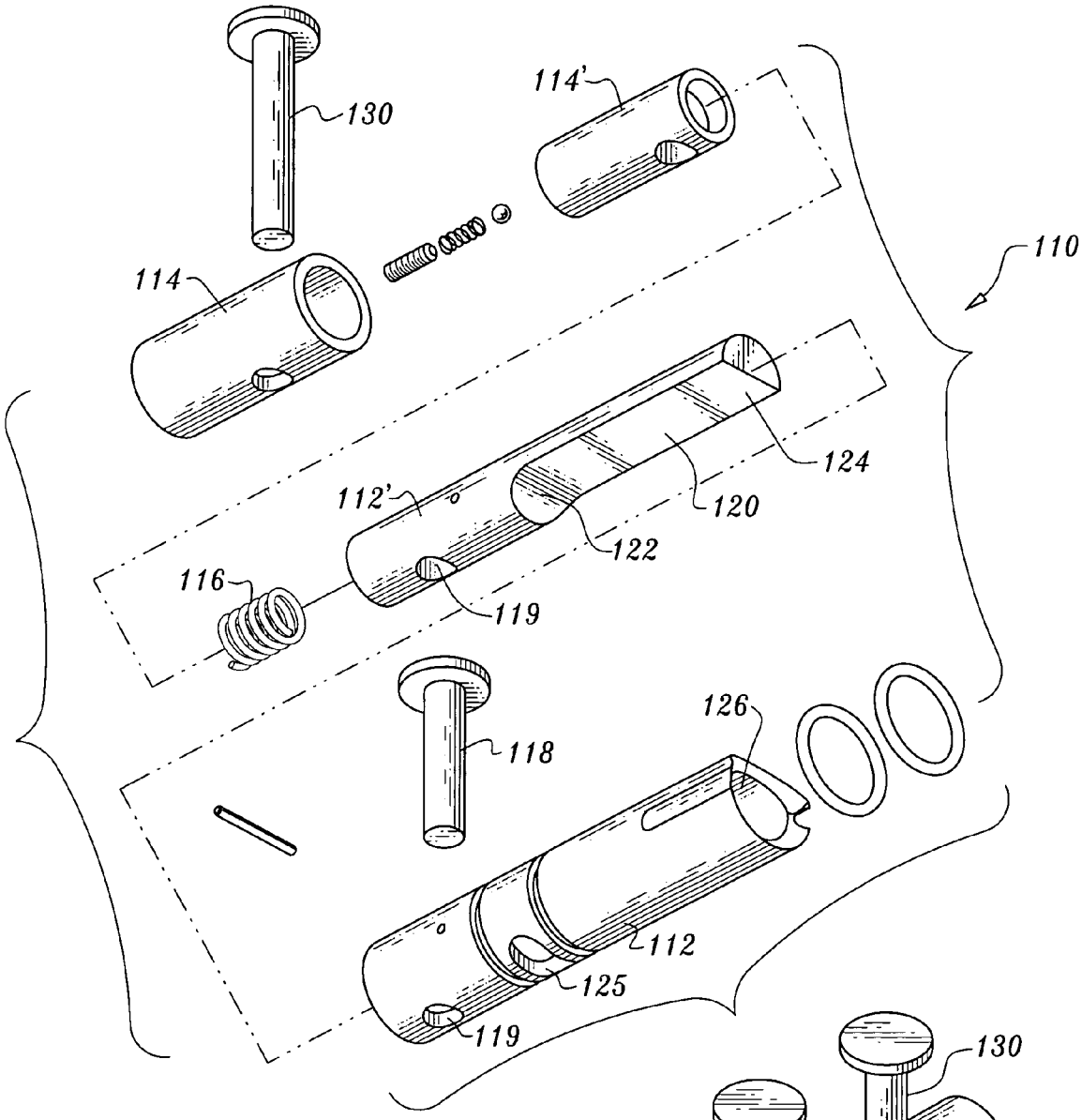
FIG. 25 is an exploded parts view of the compound bolt of this alternative embodiment.
Figure 26:
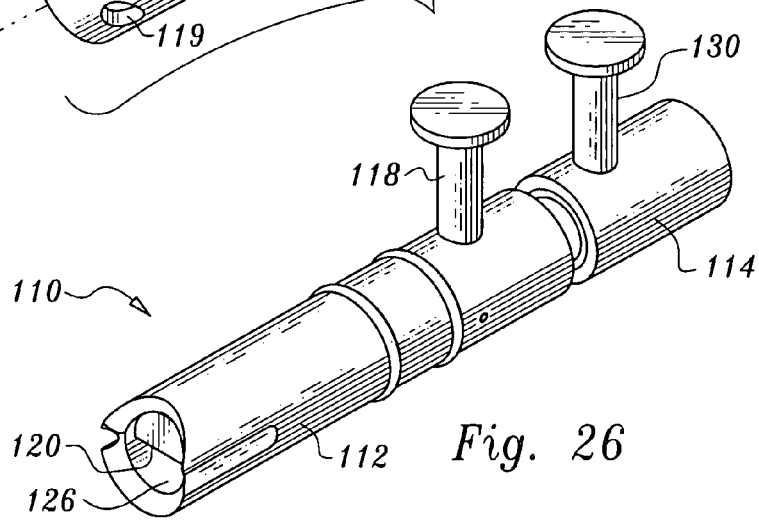
FIG. 26 is a perspective view of the compound bolt shown assembled.

In particular, and with reference to FIGS. 21-24, initially the compound bolt 110 is in a rearward position allowing a ball B to drop from the feed tube 60 down into the prechamber 9. When the firing sequence is initiated, the hammer 47 of the ram 40 moves forward causing the ball B to be pushed from the prechamber 9 to the firing chamber 8 and causing the feed tube 6 to be closed off. Also, the inlet 125 below the guide surface 120 is brought into precise alignment with the hole above the outlet 69 in the main valve 60. The forward portion 112 is configured so that just as the inlet 125 comes into precise alignment with the outlet 69 of the main valve 60, the stop post 118 of the compound bolt 110 strikes the stop surface 117 so that the forward portion 112 stops moving. Thus, as shown in FIG. 22, both the forward portion 112 moves along arrow K and the rearward portion 114 moves along arrow L.

After the stop post 118 strikes the stop surface 117, the forward portion 112 ceases moving and the high pressure air pathway along the guide surface 120 is completely ready for optimal handling of high pressure air flow. The hammer 47 continues to move, so that the rearward portion 114 continues to move along arrow L (FIG. 23) and the spring 116 is caused to be compressed. Also, the hammer 47 begins to strike the pin 68 of the main valve 60, causing high pressure air to pass through the main valve 60. This high pressure air has the benefit of passing against a guide surface 120 which is entirely stationary, and striking the ball B for launch out of the barrel 4. When the ram assembly 40 cycles back to retract the hammer 47 away from the main valve 60, the rearward portion 114 and forward portion 112 of the compound bolt 110 are each retracted back to the position shown in FIG. 21, such that another ball B can be dropped into the prechamber 9 and the firing sequence repeated.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. A paintball marker comprising in combination:

a high pressure air source;

a body;

said body adapted to support a barrel, a firing chamber, a paintball input and a main valve;

said main valve adapted to allow high pressure air from said high pressure air source to said firing chamber when open;

a trigger;

a ram assembly, said ram assembly including a housing with a bore therein, said bore having a piston therein and adapted to move within said bore, said piston adapted to move when said trigger is actuated, said ram assembly further including a shaft coupled to said piston, said shaft adapted to move when said piston moves, said shaft further adapted to open said main valve when said piston moves and said ram assembly is located adjacent said main valve; and wherein said ram is adapted to operate in a manner moving said piston both when said ram assembly is adjacent said main valve and when said ram assembly is spaced from said main valve.

2. The marker of claim 1 wherein said ram assembly having a flexible air coupling adapted to deliver air to said bore to move said piston.

3. The marker of claim 2 wherein said flexible air coupling includes a hose, said hose coupled to said source of high pressure air through a regulator, said regulator adapted to reduce a pressure of high pressure air at said high pressure air source to a lower pressure than air at said high pressure air source before delivery to said hose.

4. The marker of claim 3 wherein said ram assembly includes an electropneumatic valve adapted to selectively deliver air to said bore of said ram assembly responsive to electric signals at least partially generated by movement of said trigger.

5. The marker of claim 4 wherein said electropneumatic valve is fixed in position relative to said ram assembly.

6. The marker of claim 5 wherein said trigger is coupled to an electric switch, said switch adapted to generate an electric signal when closed by actuation of said trigger, said electric signal carried on wires flexibly coupling said switch and said trigger to said electropneumatic valve, such that said ram assembly, including said electropneumatic valve, can move relative to said trigger.

7. The marker of claim 6 wherein said body includes two portions including an upper body portion and a lower body portion, said upper body portion adapted to support said barrel, said firing chamber, said paintball input and said main valve, said lower body portion adapted to support said trigger and said switch, said ram assembly selectively coupleable to both said upper body portion and said lower body portion.

8. The marker of claim 7 wherein a hammer is fixed to an end of said shaft opposite said piston, said hammer adapted to contact said main valve.

9. The marker of claim 1 wherein a bolt is located adjacent said firing chamber, said bolt adapted to selectively block said paintball input and slide within a bore aligned with said firing chamber and said barrel.

10. The marker of claim 9 wherein said bolt includes a post, said post adapted to selectively couple said bolt to said shaft of said ram assembly, such that said bolt moves with said shaft of said ram assembly when said post is in use, and with said shaft of said ram assembly adapted to be decoupled from said bolt by removal of said post.

11. The marker of claim 10 wherein said shaft includes a hammer thereon, said hammer including a hole in a side thereof, said hole adapted to receive a portion of said post therein.

12. A method for troubleshooting a paintball marker, the paintball marker configured to include a high pressure air source, a body, said body adapted to support a barrel, a firing chamber, a paintball input and a main valve, said main valve adapted to allow high pressure air from said high pressure air source to said firing chamber when open, a trigger, a ram assembly, said ram assembly including a housing with a bore therein, said bore having a piston therein and adapted to move within said bore, said piston adapted to move when said trigger is actuated, said ram assembly further including a shaft coupled to said piston, said shaft adapted to move when said piston moves, said shaft further adapted to open said main valve when said piston moves and said ram assembly is located adjacent said main valve and wherein said ram is adapted to operate in a manner moving said piston both when said ram assembly is adjacent said main valve and when said ram assembly is spaced from said main valve; the method including the steps of:

moving the ram assembly away from the main valve while the ram assembly is still coupled to the trigger;

actuating the trigger; and observing whether or not the hammer moves in response to actuation of the trigger.

13. The method of claim 12 including the further step of configuring the body to include an upper body portion and a lower body portion with said trigger located within said lower body portion and with said main valve located within said upper body portion.

14. The method of claim 13 wherein said moving step includes the step of spacing the ram assembly from both the upper body portion and the lower body portion.

15. The method of claim 14 wherein said moving step includes the further step of removing a bolt from the ram assembly.

16. A high pressure air powered firearm, comprising in combination:

a high pressure air source;

a body;

said body adapted to support a barrel, a firing chamber, a projectile input and a main valve;

said main valve adapted to allow high pressure air from said high pressure air source to said firing chamber when open;

a trigger;

a ram assembly, said ram assembly including a housing with a bore therein, said bore having a piston therein and adapted to move within said bore, said piston adapted to move when said trigger is actuated, said ram assembly further including a shaft coupled to said piston, said shaft adapted to move when said piston moves, said shaft further adapted to open said main valve when said piston moves and said ram assembly is located adjacent said main valve; and wherein said ram is adapted to operate in a manner moving said piston both when said ram assembly is adjacent said main valve and when said ram assembly is spaced from said main valve.

17. The marker of claim 16 wherein said ram assembly includes an electropneumatic valve adapted to selectively deliver air to said bore of said ram assembly responsive to electric signals at least partially generated by movement of said trigger.

18. The marker of claim 17 wherein said electropneumatic valve is fixed to said ram assembly.

19. The marker of claim 18 wherein said trigger is coupled to an electric switch, said switch adapted to generate an electric signal when closed by actuation of said trigger, said electric signal carried on wires flexibly coupling said switch and said trigger to said electropneumatic valve, such that said ram assembly, including said electropneumatic valve, can move relative to said trigger.

20. The marker of claim 16 wherein said body includes two portions including an upper body portion and a lower body portion, said upper body portion adapted to support said barrel, said firing chamber, said paintball input and said main valve, said lower body portion adapted to support said trigger and said switch, said ram assembly selectively coupleable to both said upper body portion and said lower body portion.

* * * * *